US005702081A

United States Patent [19]

Gallemore, II

[11] Patent Number: 5,702,081

[45] Date of Patent: Dec. 30, 1997

[54] BRACKET APPARATUS

[75] Inventor: William E. Gallemore, II, Colleyville, Tex.

[73] Assignee: National Banner Company, Inc., Dallas, Tex.

[21] Appl. No.: 571,767

[22] Filed: Dec. 13, 1995

[51] Int. Cl.[6] ..... A47B 96/06

[52] U.S. Cl. ..... 248/218.4; 248/219.1; 248/219.4

[58] Field of Search ..... 248/218.4, 219.1, 248/219.4, 220.1, 230.8, 220.22, 219.3, 223.41, 228.8, 534

[56] References Cited

U.S. PATENT DOCUMENTS

| | | | |
|---|---|---|---|
| D. 362,465 | 9/1995 | Gallemore, II | D20/41 |
| 1,020,396 | 3/1912 | Blank . | |
| 1,401,626 | 12/1921 | Mader . | |
| 1,677,379 | 7/1928 | Ames . | |
| 1,712,691 | 5/1929 | Carlson . | |
| 3,034,242 | 5/1962 | Gold . | |
| 3,089,268 | 5/1963 | Frey et al. . | |
| 3,240,863 | 3/1966 | Brede | 248/219.1 |
| 3,559,941 | 2/1971 | Holzman | 248/228.8 |
| 3,564,743 | 2/1971 | Gilmoure . | |
| 3,812,815 | 5/1974 | Kuenzel . | |
| 3,850,401 | 11/1974 | Snediker | 248/291 |
| 4,325,529 | 4/1982 | Seebinger | 248/218.4 |
| 4,341,029 | 7/1982 | Heard | 248/230.8 |
| 4,593,877 | 6/1986 | van der Wyk | 248/512 |
| 4,880,195 | 11/1989 | Lepley | 248/219.4 |
| 5,070,809 | 12/1991 | Fox et al. | 116/174 |
| 5,172,881 | 12/1992 | Stein | 248/231 |
| 5,212,898 | 5/1993 | Dinan et al. | 248/219.4 |
| 5,267,524 | 12/1993 | Maxwell | 116/174 |
| 5,310,151 | 5/1994 | Engel | 248/230.8 |
| 5,320,322 | 6/1994 | Williams | 248/514 |
| 5,423,281 | 6/1995 | Crookham et al. | 116/173 |
| 5,463,973 | 11/1995 | Tait | 248/219.4 |

FOREIGN PATENT DOCUMENTS 332408 7/1930 United Kingdom .

OTHER PUBLICATIONS

NAP 1993 World of Colors Catalog, pp. 17 and 32.
NABCO 1993–94 Catalog, pp. 24–25.
NABCO 1994–95 Catalog, pp. 9, 15, 24, 25, 30 and 31.

*Primary Examiner*—Leslie A. Braun
*Assistant Examiner*—Kimberly Wood
*Attorney, Agent, or Firm*—Anthony E. J. Campbell; Randall C. Brown; Locke Purnell Rain Harrell

[57] ABSTRACT

A bracket apparatus for mounting a cantilevered banner assembly to an upstanding pole. The cantilevered banner assembly has a cantilever strut and the pole has at least one generally planar surface. The bracket apparatus includes a generally C-shaped bracket having apertures for receiving the cantilever strut, at least one fastening strap passing through an aperture in the C-shaped bracket and encircling the pole, and a mounting bracket that is sandwiched between the pole and the C-shaped bracket. The mounting bracket has a first surface engaged with the planar surface of the pole and a second surface that secures the C-shaped bracket to the mounting bracket.

16 Claims, 3 Drawing Sheets

BRACKET APPARATUS

BACKGROUND OF THE INVENTION

1. Field of the Invention

The present invention relates to bracket mounting systems and, more particularly, to a bracket apparatus for mounting to an upstanding pole having at least one generally planar surface. The present invention has particular utility in connection with the support of a flag or banner display system such as the system described in U.S. patent application Ser. No. 08/271,045 (hereinafter, the "'045 application"), the entire disclosure of which is incorporated herein by reference.

2. Description of the Related Information

It is frequently desirable to connect a banner display system to an upstanding pole, such that the banner is clearly visible to those whose attention is desired. A bracket apparatus such as that described in the '045 application may be employed for this purpose, such that a cantilevered banner support assembly extends from and is supported by the bracket apparatus which is in turn secured to the upstanding pole. The term "banner," as used herein, means flags, banners, signs, and other similar indicia.

In the '045 application, a bracket having a generally C-shaped cross-section (the "C-bracket") has two sidewalls, each bearing a primary aperture adapted to receive a cantilevered strut which extends from the banner assembly. The C-bracket is mounted such that the termini of the two sidewalls abut the upstanding pole. Fastening straps which pass through secondary apertures in each sidewall encircle the pole and may be tensioned so as to secure the C-bracket in this position. When the strut is disposed through both primary apertures, proper cantilever support is provided for the banner assembly.

The term "C-shaped," as used herein, includes any curved or bent shape, such as a "V" shape, that is capable of engaging the pole as described.

Though effective when used in connection with poles having a curved or circular cross-section, generally C-shaped members are less well-suited for secure engagement with substantially flat surfaces, such as those encountered in upstanding poles having a generally rectangular cross section. In particular, the C-bracket is prone to move on a flat surface in response to wind loading upon the banner.

Because the C-bracket is both an economical and convenient means for providing support for cantilevered systems, including a pivotal banner system as described in the '045 application, it would be a distinct advantage to provide an improved bracket apparatus, incorporating such a C-bracket, for poles having a planar surface and a generally rectangular cross-section.

SUMMARY OF THE INVENTION

The apparatus of the present invention overcomes the above-mentioned disadvantages and drawbacks which are characteristic of the related information. More particularly, a preferred embodiment of the present invention comprises a bracket apparatus for securing a cantilevered banner assembly to an upstanding pole having at least one generally planar surface.

In a preferred embodiment, the bracket apparatus of the present invention comprises a generally "L" shaped bracket (the "L-bracket") adapted to abuttingly engage and conform to a planar surface of an upstanding pole, to also abuttingly engage and conform to a side surface of the pole disposed at an edge of the planar surface, and to engagingly receive a second, generally "C" shaped bracket (the "C-bracket") such as that described in the '045 application.

In a preferred embodiment, first and second body portions of the L-bracket are joined to form an angle on the order of 90° so as to properly abut a right angle between the planar and side surfaces of the pole. Generally parallel channels formed on the top surface of the first body portion of the L-bracket nestingly engage the sidewalls of the C-bracket.

In a preferred embodiment, fastening straps pass through corresponding apertures in the sidewalls of the C-bracket, substantially as described in the '045 application, such that a loop is formed through the C-bracket and around the pole. The engaged L-bracket is sandwiched between the C-bracket and the pole, which is abutted as the fastening straps are tensioned. In a preferred embodiment, a gasket is disposed between the L-bracket and the pole.

The C-bracket and L-bracket combination provides means for supporting a banner assembly. In a preferred embodiment, the banner assembly is as described in the '045 application. In another preferred embodiment, the banner assembly comprises a single support strut which extends in a cantilevered manner from the C-bracket such that a banner may be hung from the single support strut using hooks, loops or similar support means.

BRIEF DESCRIPTION OF THE DRAWINGS

For a more complete understanding of the present invention and for further objects and advantages thereof, reference may now be had to the following description taken in conjunction with the accompanying drawings in which.

DESCRIPTION OF THE PREFERRED EMBODIMENTS

Figure 1:
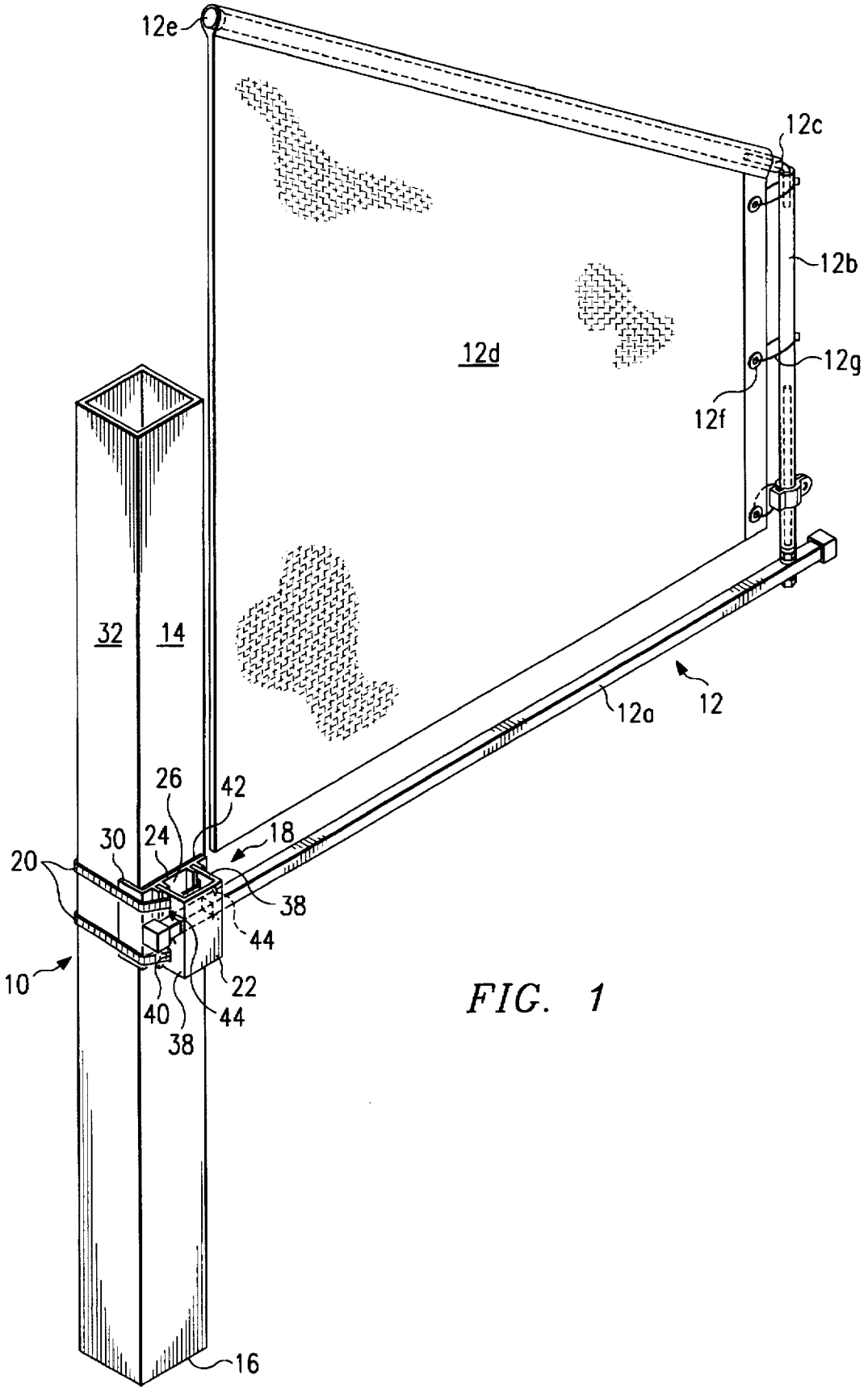
FIG. 1 is a perspective view of a bracket apparatus according to the present invention, upon which is mounted a banner assembly according to the '045 Application.
Figure 2:
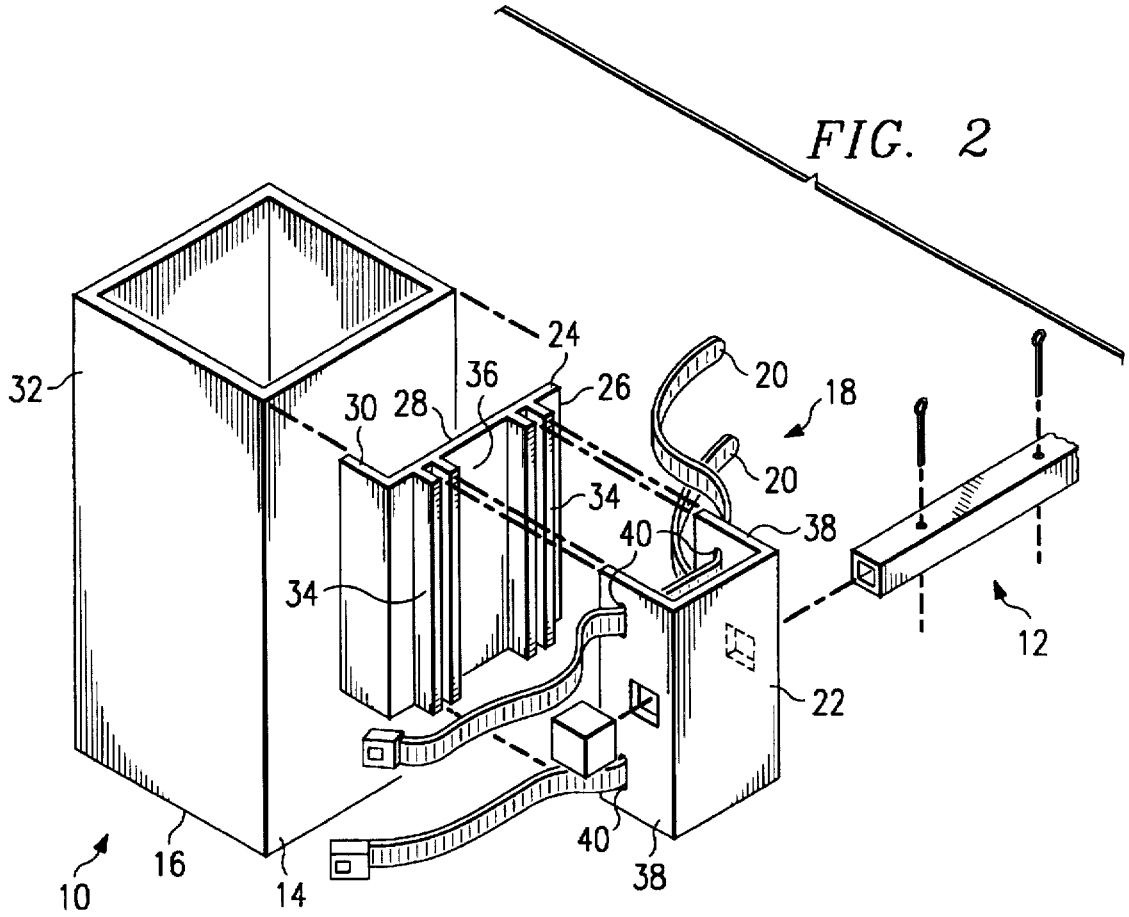
FIG. 2 is a fragmentary, exploded perspective view of the bracket apparatus shown in FIG. 1.
Figure 3:
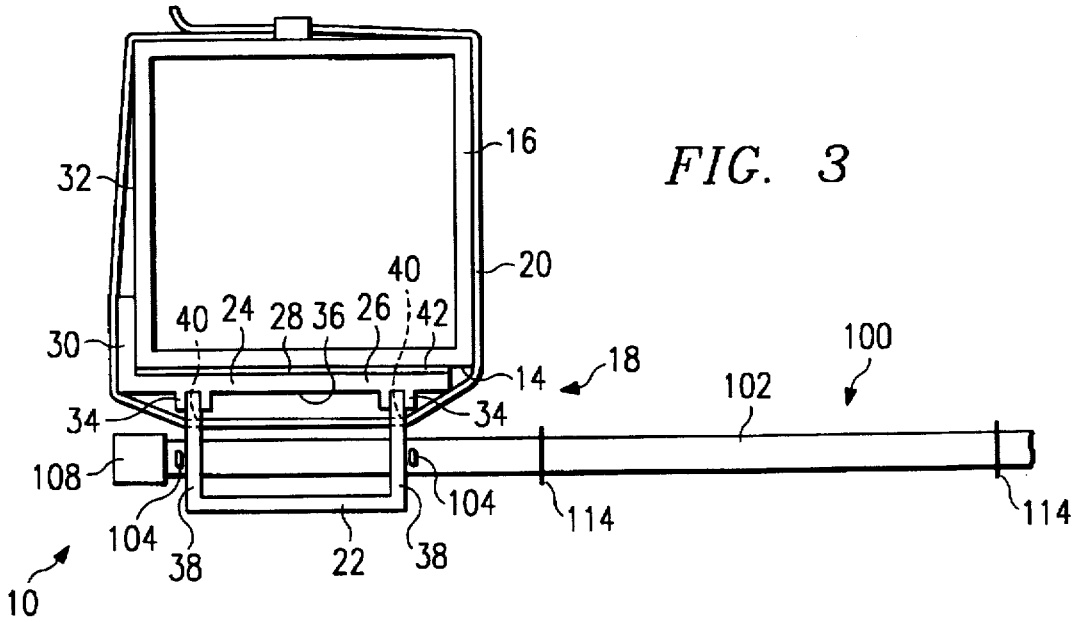
FIG. 3 is a top plan view of the bracket apparatus shown in FIG. 2, upon which is mounted a banner assembly according to the present invention.

Referring now to the drawings, and particularly to FIGS. 1–3, a preferred embodiment of the bracket apparatus of the present invention is shown and generally designated by the reference numeral 10. Referring to FIG. 1, the bracket apparatus 10 is attached to a planar surface 14 of an upstanding pole 16 and a banner assembly 12 extends therefrom. The bracket apparatus 10 comprises a bracket assembly 18 which is secured to the planar surface 14 using a plurality of fastening straps 20.

Referring now to FIGS. 1–3, in a preferred embodiment of the present invention the bracket assembly 18 comprises a C-bracket 22 according to the '045 application and an L-bracket 24 adapted for mating engagement with the C-bracket 22. The L-bracket 24 comprises a first body portion 26, having a generally planar surface 28 adapted for flush mounting against the planar surface 14 of pole 16, and a second body portion 30 which preferably extends generally orthogonally from the first body portion 26 so as to abuttingly engage a side surface 32 of pole 16.

Those of ordinary skill in the art will recognize that while an orthogonal arrangement is suitable for a pole 16 having a rectangular cross-section, the first and second body portions 26, 30 of the L-bracket 24 may be oriented at other angles with respect to one another so as to accommodate differing pole shapes.

In a preferred embodiment, a pair of grooves or channels 34 is formed in the top surface 36 of the first body portion 26 of the L-bracket 24, and is adapted to receive the sidewalls 38 of the C-bracket 22.

In operation of the bracket apparatus 10, the C-bracket 22 and L-bracket 24 are engaged. The fastening straps 20 are passed through apertures 40 in the sidewalls 38 of the C-bracket 22, and then around the L-bracket 24 and the pole 16, so as to sandwich the L-bracket 24 and the C-bracket 22 together against the planar surface 14 of pole 16 when the fastening straps 20 are tensioned. In a preferred embodiment, a gasket 42 (shown in FIGS. 1 and 3) is placed between the L-bracket 24 and the planar surface 14 of the pole 16.

In a preferred embodiment, two parallel fastening straps 20 are employed. Those of ordinary skill in the art will recognize, however, that the number of straps 20 necessary to support the banner assembly 12 may be more or less than two depending upon the associated load imposed on the bracket apparatus 10.

In a preferred embodiment, the bracket apparatus 10 is used in conjunction with a banner assembly 12 according to the '045 application (as shown in FIG. 1), which is connected to the C-bracket 22. The '045 banner assembly 12 comprises a cantilever strut 12*a*, a hollow upstanding strut 12*b*, a hollow upper strut 12*c*, and a banner 12*d* having an upper sleeve 12*e*.

In a preferred embodiment, the cantilever strut 12*a* passes through two mutually aligned apertures 44 in the sidewalls 38 of the C-bracket 22, each said aperture 44 having shape generally complementary to a cross-section of the cantilever strut 12*a*, such that the strut 12*a* may be cantilevered off the C-bracket 22 as described in the '045 application.

The upstanding strut 12*b* extends perpendicularly upward from the cantilever strut 12*a*, and the upper strut 12*c* is connected at the top of the upstanding strut 12*b*. The sleeve 12*e* of the banner 12*d* may slide over the upper strut 12*c* and the banner 12*d* may hang down therefrom. The banner 12*d* may also comprise loopholes 12*f* through which loops or hooks 12*g* may pass for securement with the upstanding strut 12*b*.

Although use in connection with the banner assembly 12 is shown, those of ordinary skill in the art will recognize that the bracket apparatus 10 may be used in all manner of cantilever support applications, and may particularly be used in connection with the banner assembly 100 shown in FIGS. 3 and 4 and further described below.

Figure 4:
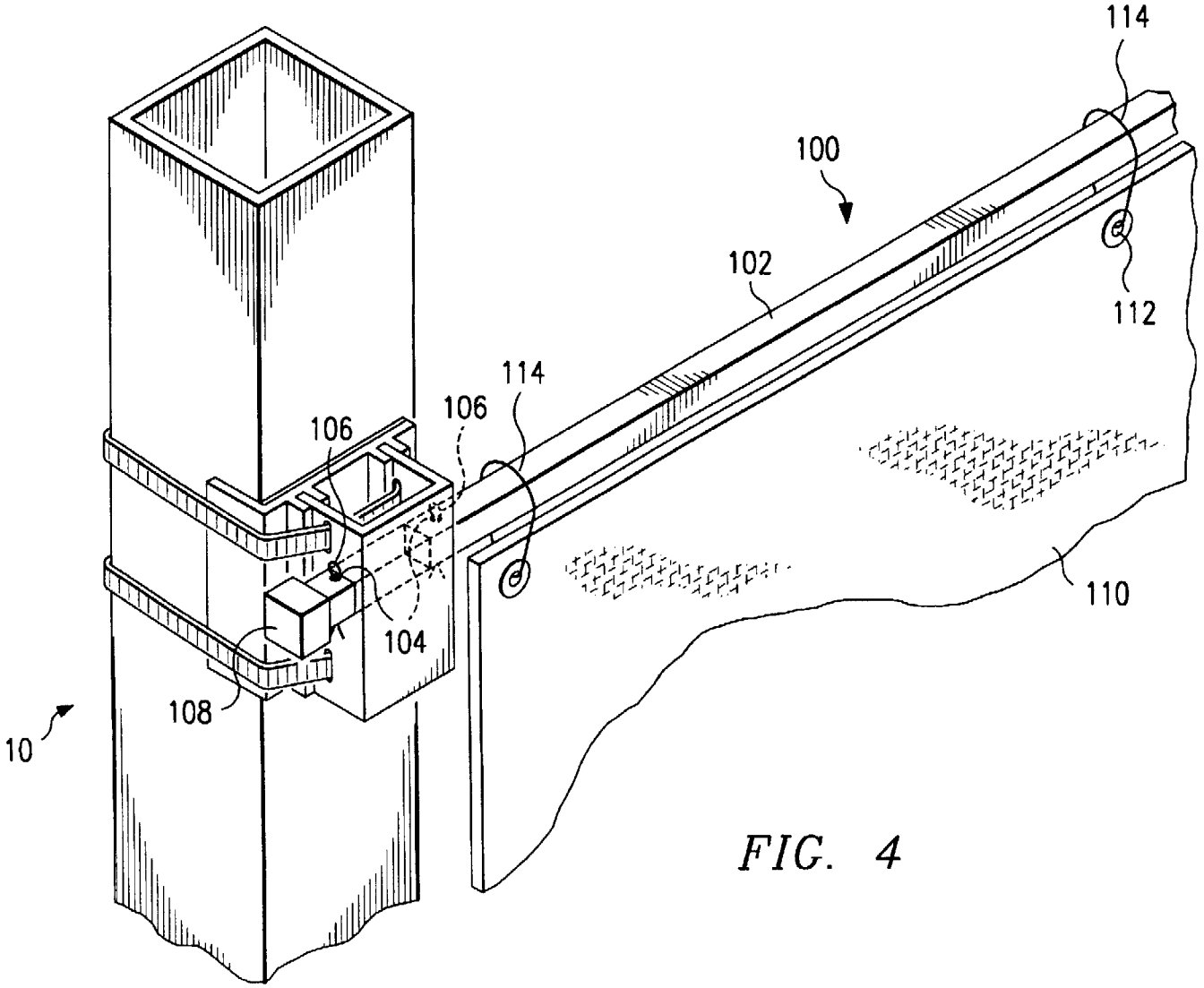
FIG. 4 is a fragmentary perspective view of the bracket apparatus and banner assembly shown in FIG. 3.

Referring now to FIGS. 3 and 4, an alternate banner assembly according to the present invention is shown and generally designated by the reference numeral 100. In a preferred embodiment, the banner assembly 100 comprises a strut 102 which passes through two mutually aligned apertures 104 in the sidewalls 38 of the C-bracket 22, each said aperture 104 having shape generally complementary to a cross-section of the strut 102, such that the strut 102 may be cantilevered off the C-bracket 22 as described in the '045 Application.

While a strut 102 having a rectangular cross-section is shown, those of ordinary skill in the art will recognize that a circular rod or other member may be used for the strut 102, so long as the shape of the apertures 104 is adapted accordingly. Those of ordinary skill in the art will also recognize that the fastening straps 20 may pass through the apertures 104, thereby eliminating the need for one or more separate fastener apertures 40.

In a preferred embodiment, lateral motion of the strut 102 is restricted by fasteners 106, such as cotter pins, and a cap 108 is provided to cover the end of the strut 102. The strut 102 supports a depending banner 110 which is formed with apertures 112, which provide means for securing the banner 110 to the strut 102 using fasteners 114 such as loops or hooks.

It is thus believed that the operation and construction of the present invention will be apparent from the foregoing description. While the apparatus shown or described has been characterized as being preferred it will be obvious that various changes and modifications may be made therein without departing from the spirit and scope of the invention as defined in the following claims.

What is claimed is:

1. A bracket apparatus for mounting a cantilevered assembly to a pole, said cantilevered assembly comprising a cantilever strut, and said pole comprising a first planar surface and a second planar surface, wherein said bracket apparatus comprises:

a) a generally C-shaped bracket having opposed sidewalls, each said sidewall having a primary aperture adapted to receive said cantilevered strut, and at least one secondary aperture;

b) at least one fastening strap passing through said at least one secondary aperture in each said sidewall of said C-shaped bracket and adapted to encircle said pole;

c) a mounting bracket adapted to be sandwiched between said pole and said C-shaped bracket, comprising a first body portion and a second body portion, said first body portion of said mounting bracket having a first surface adapted to abuttingly engage said first planar surface of said pole and a second surface having means for securing said C-shaped bracket to said mounting bracket, said second body portion of said mounting bracket having a first surface adapted to abuttingly engage said second planar surface of said pole.

2. A bracket apparatus according to claim 1 comprising two fastening straps and two secondary apertures in each said sidewall of said C-shaped bracket.

3. A bracket apparatus according to claim 1 further comprising a gasket disposed between said mounting bracket and said planar surface of said pole.

4. A bracket apparatus according to claim 1 wherein said securing means of said mounting bracket comprise first and second grooves formed in said second surface and adapted to matingly receive said sidewalls of said C-shaped bracket.

5. A bracket apparatus according to claim 4 wherein said grooves are formed in said second surface in a generally parallel relationship.

6. A bracket apparatus according to claim 1 wherein said securing means of said mounting bracket comprise first and second channels disposed on said second surface and adapted to receive said sidewalls of said C-shaped bracket.

7. A bracket apparatus according to claim 6 wherein said channels are formed on said second surface in a generally parallel relationship.

8. A bracket apparatus according to claim 1 wherein said second body portion extends orthogonally from said first surface of said first body portion so as to define a generally L-shaped member.

9. A bracket apparatus according to claim 1 wherein said C-shaped bracket and said mounting bracket are each formed of aluminum.

10. A bracket apparatus according to claim 1 wherein said C-shaped bracket and said mounting bracket are each formed by an extrusion process.

11. A bracket apparatus according to claim 1 wherein said at least one fastening strap comprises a metal locking strap.

12. A bracket apparatus according to claim 1 wherein said at least one fastening strap comprises a plastic locking strap.

13. An apparatus for mounting a banner to a pole, said banner comprising a top having a plurality of loopholes, said pole comprising a first planar surface and a second planar surface, wherein said apparatus comprises:

a) a cantilevered strut;

b) a plurality of fastening loops for passing through said loopholes and around said cantilevered strut;

c) a generally C-shaped bracket having opposed sidewalls, each said sidewall having a primary aperture adapted to receive said cantilevered strut, and at least one secondary aperture;

d) at least one fastening strap passing through said at least one secondary aperture in each said sidewall of said C-shaped bracket and adapted to encircle said pole; and e) a mounting bracket adapted to be sandwiched between said pole and said C-shaped bracket, comprising a first body portion and a second body portion, said first body portion of said mounting bracket having a first surface for abuttingly engaging said first planar surface of said pole and a second surface having means for securing said C-shaped bracket to said mounting bracket, said second body portion of said mounting bracket having a first surface for abuttingly engaging said second planar surface of said pole.

14. A banner assembly according to claim 13 wherein said cantilevered strut further comprises means to prevent lateral translation of said strut within said primary apertures of said C-bracket.

15. A banner assembly according to claim 14 wherein said translation prevention means comprise at least one cotter pin disposed through said cantilevered strut adjacent to one of said sidewalls of said C-bracket.

16. An apparatus for mounting a banner to a pole, said banner comprising a sleeve and a plurality of loopholes, said pole comprising a first planar surface and a second planar surface, wherein said apparatus comprises:

a) a cantilevered strut;

b) an upstanding strut connected to and extending upwardly from said cantilevered strut;

c) an upper strut for passing through said sleeve in said banner and connected to said upstanding strut;

d) a plurality of fastening loops for passing through said loopholes and around said upstanding strut;

e) a generally C-shaped bracket having opposed sidewalls, each said sidewall having a primary aperture adapted to receive said cantilevered strut, and at least one secondary aperture;

f) at least one fastening strap passing through said at least one secondary aperture in each said sidewall of said C-shaped bracket and adapted to encircle said pole; and g) a mounting bracket adapted to be sandwiched between said pole and said C-shaped bracket, comprising a first body portion and a second body portion, said first body portion of said mounting bracket having a first surface for abuttingly engaging said first planar surface of said pole and a second surface having means for securing said C-shaped bracket to said mounting bracket, said second body portion of said mounting bracket having a first surface for abuttingly engaging said second planar surface of said pole.

* * * * *